US008069872B2

(12) United States Patent
Bae

(10) Patent No.: US 8,069,872 B2
(45) Date of Patent: Dec. 6, 2011

(54) AUTOMATIC CONTROL DEVICE OF FOLDABLE TENT

(75) Inventor: Jin-Ho Bae, Fujian (CN)

(73) Assignee: Poong Han (Xiamen) Engineering Co., Ltd, Fujian (CN)

( * ) Notice: Subject to any disclaimer, the term of this patent is extended or adjusted under 35 U.S.C. 154(b) by 0 days.

(21) Appl. No.: 11/858,207

(22) Filed: Sep. 20, 2007

(65) Prior Publication Data

US 2009/0078297 A1 Mar. 26, 2009

(51) Int. Cl.
*E04H 15/48* (2006.01)

(52) U.S. Cl. ..... 135/147

(58) Field of Classification Search ..... 135/135, 135/143, 144, 147, 159; 403/218, 170
See application file for complete search history.

(56) References Cited

U.S. PATENT DOCUMENTS

| | | | | |
|---|---|---|---|---|
| 4,750,509 | A * | 6/1988 | Kim | 135/135 |
| 4,966,178 | A * | 10/1990 | Eichhorn | 135/123 |
| 5,046,882 | A * | 9/1991 | Ju | 403/170 |
| 5,293,890 | A * | 3/1994 | Park et al. | 135/98 |
| 7,040,585 | B2 * | 5/2006 | Cheng et al. | 248/200 |
| 2006/0076045 | A1 * | 4/2006 | Lee | 135/144 |
| 2007/0051399 | A1 * | 3/2007 | Jung | 135/135 |

* cited by examiner

*Primary Examiner* — Noah Chandler Hawk

(57) ABSTRACT

The present invention provides an automatic control device of foldable tent connecting to several roof strut sets wherein, said control device is of a central standing base containing a sliding hub, a spring and a tappet roller at inside. Cooperating to an extra force exerting on the central standing base to press it down relative to the roof strut sets, the sliding hub brings the tappet roller continuously to go down and up, by means of the special design between the spring and all the pushing lugs and hook slots of the tappet roller, positioning the sliding hub with the locking pin of the central standing base can be carried out, so that the tent can be opened and kept in open configuration automatically; when repeatedly press down the central standing base relative to the roof strut sets, the tent can be closed.

10 Claims, 7 Drawing Sheets

AUTOMATIC CONTROL DEVICE OF FOLDABLE TENT

BACKGROUND OF THE INVENTION

1. Field of the Invention

The present invention relates to a tent or an awning, and more particularly to an automatic control device of the roof staying mechanism on the same.

2. Description of Prior Art

The tents or awnings are leisure apparatuses in various styles standing outdoors, such as used in climbing, fishing, or picnicking outdoor leisure action. In accordance with the profile shapes of the conventional arts, they can be divided into ridge, igloo, framed, bell and so on; according to the folding or unfolding way, they are classified into conventional frame folding tent and umbrella folding tent in the manual operation framework.

Regarding to the umbrella folding tent, the framework and folding or unfolding operation are just like to the umbrella. The typical structure of it, as shown in FIG. 1, is typically to locate a static hub 10 at the center top for connecting with all the roof strut sets 40 in radial, therein said roof strut set 40 is comprised of several segments (three in the commonest) connected each other by pivoting connectors for facilitating to folding, and awning is fixed on the top sides of all the roof strut sets 40 flatly by fixing the rim of said awning on the outer ends of said roof strut sets 40 respectively, so as to construct an open-able tent. A main pole is located at the bottom side of said static hub 10 for fitting on a sliding hub 20 movingly; said sliding hub 20 is used for connecting one ends of all aid-strut rods 30 in radial coordinately, the another ends of said aid-strut rods 30 are respectively connected on the trunks of the first segments of said roof strut sets 40 pivotally. A spring 50 is positioned between said static hub 10 and said sliding hub 20, and it is in compression state as the tent is in folded configuration; as tending to open the tent, the restoring force of the spring 50 can make all the roof strut sets 40 automatically spread up.

In accordance with the above-described structure of umbrella-style foldable tent, there are following shortcomings existing:

1. said tent is opened via the aid-strut rod 30' configuration, but the level aid-strut rods 30 are unable to push up the roof strut sets 40 directly, so it needs that user pulls down the sliding hub 20 along the trunk of the main pole, therefore adding a violent operation is inconvenient for use.
2. Building up all the aid-strut rods 30 and the main pole makes the volume of the control device of the roof staying mechanism increase greatly.

OBJECTS AND SUMMARY OF THE INVENTION

It is therefore a main object of the present invention to provide a compacted automatic control device of roof staying mechanism of foldable tent for the convenience of operation.

For achieving the above-mentioned object, the present invention provides an automatic control device of foldable tent connecting to several roof strut sets consisting of several segments serially connected in radial; wherein, said control device is typically comprised of a central standing base containing a sliding hub, a spring and a tappet roller at inside; said tappet roller is fit in the inside of the sliding hub, and is touched against with one end of said spring axially, another end of said spring is touched against the top inside surface of said central standing base; said sliding hub is connected to connectors in radial respectively and pivotally. Said connectors are respectively pivoted on the rim of said central standing base at the middle points, another ends of said connectors are individually connected to the roof strut sets; on the other hand, there are several locking pins built upon the inside of the central standing base for engaging with said tappet roller, coordinating to the said tappet roller has proper number of beveled surfaces for the locking pins pushing to roll, and proper number of catching slots for locking up the locking pins.

Said sliding hub is shaped in cross with a blind hole built upon the top center with several guide slots built on the inside wall of the blind hole axially.

Said sliding hub has four connecting slots respectively built upon the four extended legs, said each connecting slot has a through-hole built on the side walls crossly for pivoting.

Said tappet roller is a bushing having a set of pushing lugs with beveled surface built on along the top edge downward, and a set of hook slots built on along the bottom edge upward to form a receding slot between two adjacent hook slots, therein the outward functional surface of said hook slot is a beveled surface, each pushing lug exactly faces to a hook slot or a receding slot one to one.

Said tappet roller has four positioning pits built on the top side along the edge for setting reference points in combination.

Said tappet roller also has a spring sleeve with a closed bottom end, said spring sleeve extends out a flange front the top edge, on said flange of the spring sleeve there are four salient points for engaging into the four positioning pits of said tappet roller.

Said connector is an L-shaped bar, and has a pivoting slotted hole built on the front portion and a rounded front end; said connector is pivoted on said sliding hub with the slotted hole by a pivoting pin.

Said central standing base has proper number of notched slots built upon the rim in radial.

Said connector extends out two pivots from the both sides of middle portion separately for fitting into the pivot holes built on the notched slot of said central standing base.

Said central standing base is consisted of an upper cap and a low cap interlocked together, there are several locking pins set upon the inside wall of said low cap.

As utilizing above-mentioned project, by means of the cavity of said central standing base, said connectors are respectively connected between the sliding hub and the central standing base, along with exerting an extra force on the central standing base downward relative to the roof strut sets, they are turned around the pivoting points on the notched slots of said central standing base working as fulcrum to push the sliding hub moving down, cooperating to the spring combined into the tappet roller and all the pushing lugs and hook slots built on the tappet roller, to make the locking pins set upon the inside of the central standing base engage into the hook slots respectively for locating the sliding hub, so the tent is opened automatically and located; when the central standing base is pressed down again relative to the opened roof strut sets, by means of all the pushing lugs and hook slots built on the tappet roller, the sliding hub is released from the locking pins, and moved up until the tent is closed. Therefore, the tent offered by the present invention is easier operated with fewer labs; and the volume of the whole device is smaller, compacter and good look.

DETAILED DESCRIPTION OF PREFERRED EMBODIMENTS

Figure 1:
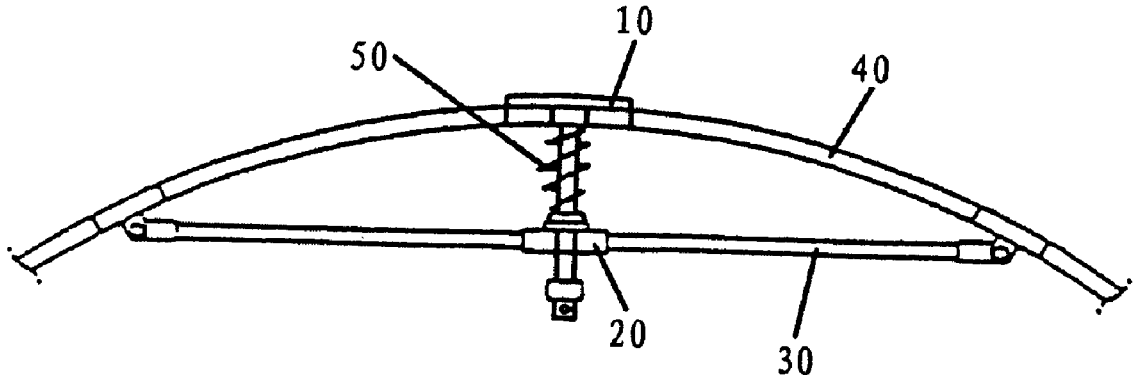
FIG. 1 PRIOR ART
FIG. 1 is a perspective view of the prior art.
Figure 2:
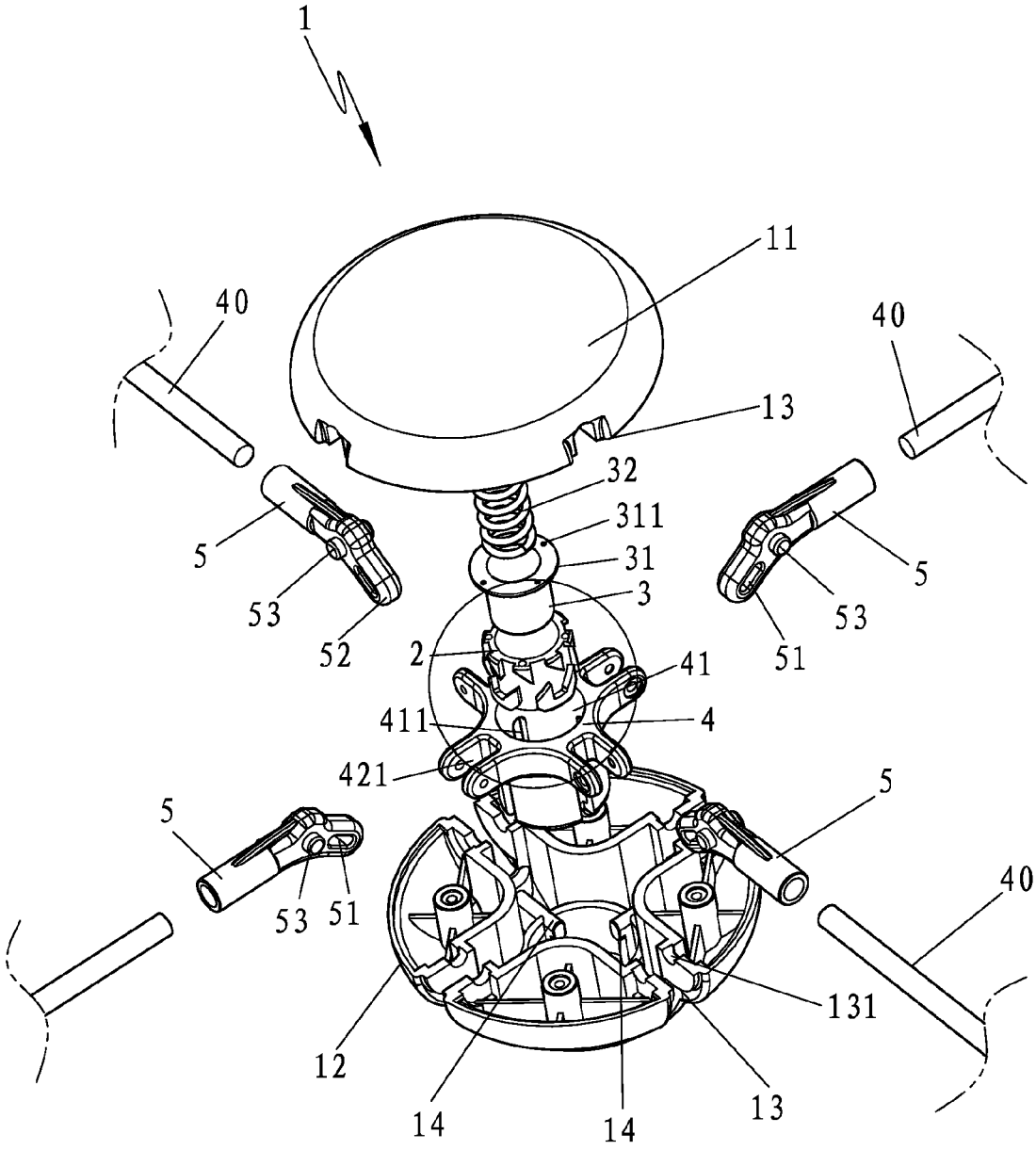
FIG. 2 is an exploded view of the present invention.
Figure 2A:
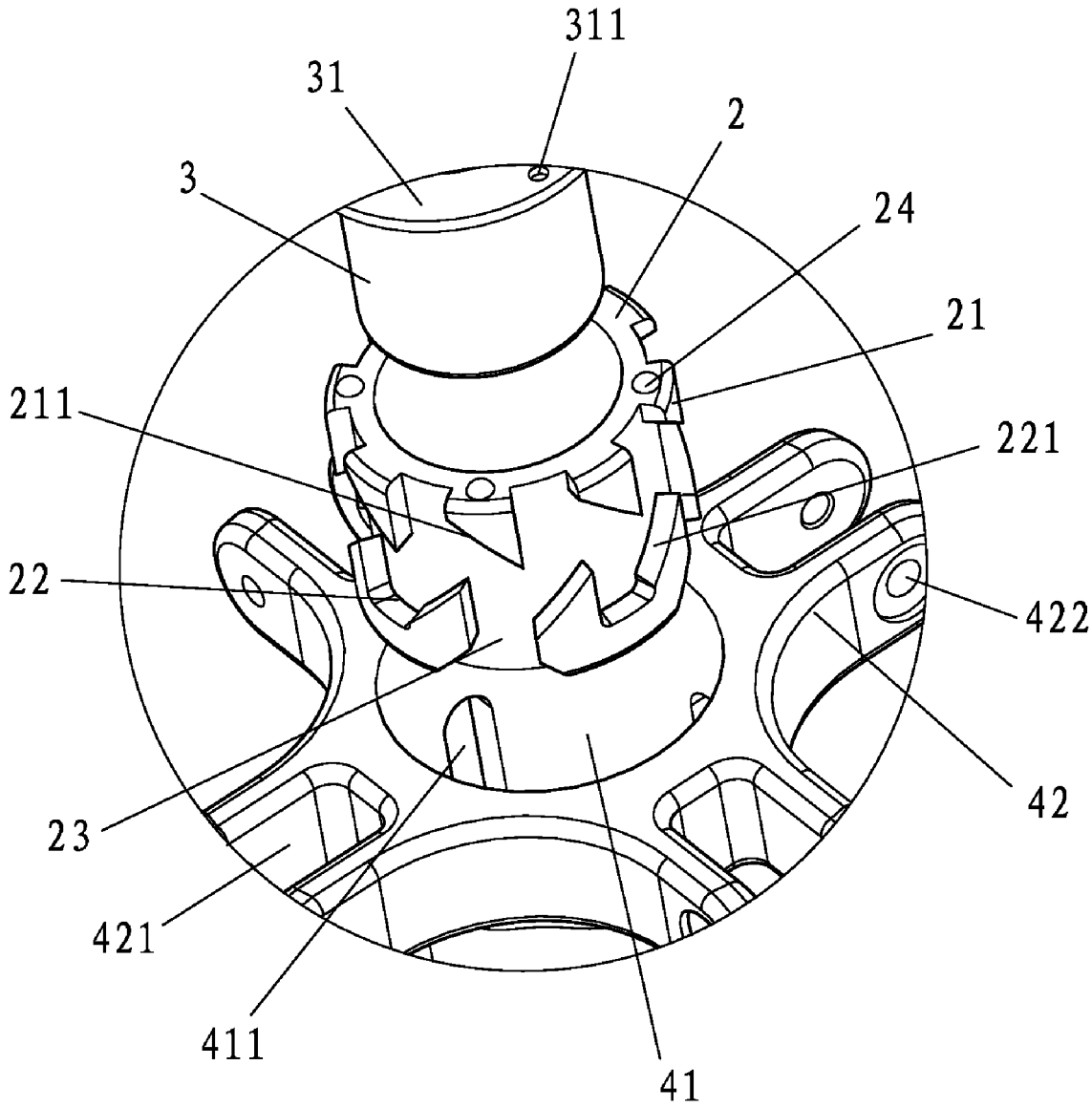
FIG. 2A is a part enlarged view of FIG. 2.
Figure 3:
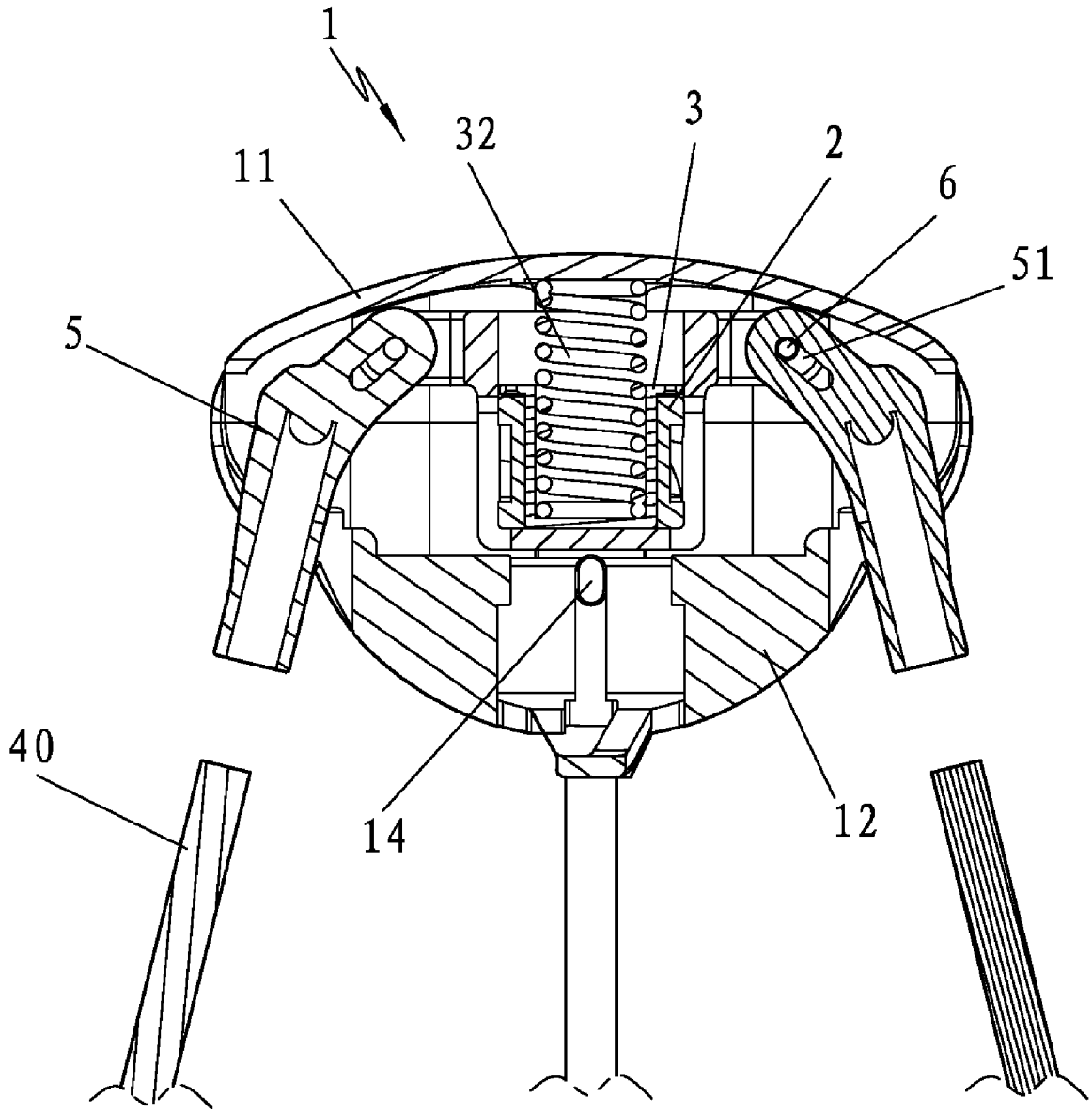
FIG. 3 is a sectional view showing the close configuration of the present invention.

Referring to FIG. 2 and FIG. 2A, co-referring to FIG. 3, an automatic control device of foldable tent provided by the present invention shown is typically to build a central standing base 1 on the top center for connecting all the roof strut sets 40 in radial (in here four sets for instance), each roof strut set 40 is consisted of several segments (in general three segments for instance).

A central standing base 1 has four notched slots 13 built on the rim in radial, and also includes an upper cap 11 and a low cap 12 interlocked together to construct a closed hollow cavity at inside; there are four locking pins 14 set upon the inside wall of said low cap below the four coordinately and respectively.

A sliding hub 4 shaped in cross is placed at inside of the hollow cavity of said central standing base 1, and has a blind hole 41 built upon the top center with four guide slots 411 built on the inside wall of the blind hole 41 axially, and four connecting slots 421 respectively built upon the four extended legs 42, said each connecting slot 421 has a through-hole 422 built on the side walls crossly for pivoting.

A tappet roller 2 is fit into the inside of said blind hole 41 of said sliding hub in clearance fit so that it can turn in the site, and is a bushing, therein a set of pushing lugs 21 with a beveled surface 211 (eight pieces in a set in this embodiment for instance) on each is built on along the top edge downward, and a set of hook slots 22 (four piece in the set in this embodiment for instance) is built on along the bottom edge upward to form a receding slot 23 between two adjacent hook slots 22, therein the outward functional surface of said hook slot 22 is a beveled surface 221, each pushing lug 21 exactly faces to a hook slot 22 or a receding slot 23 one to one, on the other hand, said tappet roller 2 also has four positioning pits 24 built on the top side along the edge for setting reference points in combination A spring sleeve 3 placed into the inside of said tappet roller 2 is a tube with a closed end extending out a flange 31 from the top open edge, on said flange 31 of the spring sleeve 3 there are four salient points 311 for engaging into the four positioning pits 24 of said tappet roller 2.

A spring 32 is held in the inside of said spring sleeve 3, the top end extended out from the spring sleeve 3 is touched against the inside wall of the upper cap 11 of said central standing base 1.

A sliding hub 4 is used to pivot respectively in radial to the slotted pivot holes 51 built on the rounded front ends 52 of four L-shaped connectors 5 connecting to the roof strut set 40 with rear end; four pivoting pins 6 respectively pivot the connectors 5 on the slots 421 of the sliding hub 4 by fitting through the pivoting holes 422 of the sliding hub 4 and the slotted hole 51 of the connector 5; and said connector 5 extends out two pivots 53 from the both sides of middle portion separately, coordinating to the pivots 53 the notched slot 13 of said central standing base 1 has through pivoting holes 131 built on, so that the middle portion of said connector 5 can be pivoted on the pivoting holes 131 on the rim of the central standing base 1 via the pivots 53.

Referring to FIG. 3, when the tent is in closed configuration, all the roof strut sets 40 are in collecting configuration to the center, in this time the sliding hub 4 is positioned on the upper portion at the inside of the central standing base 1, meanwhile the pivoting pin 6 connecting the connector 5 to the sliding hub 4 is positioned on the front end of the slotted hole 51 of the connector 5, and the spring 32 is in compressing accumulation configuration.

Figure 4:
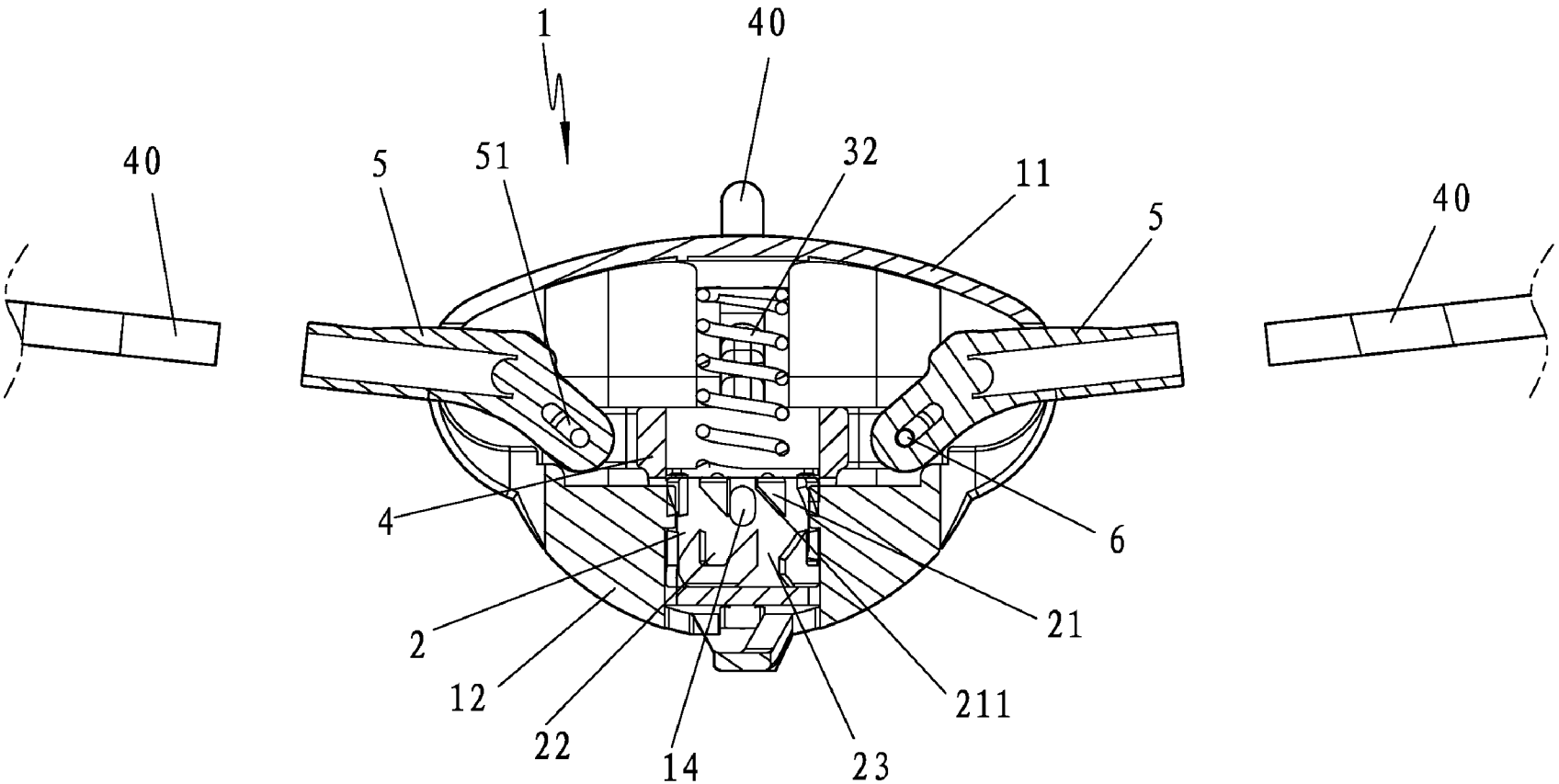
FIG. 4 is a sectional view showing the open configuration in the action 1 of the present invention.
Figure 5:
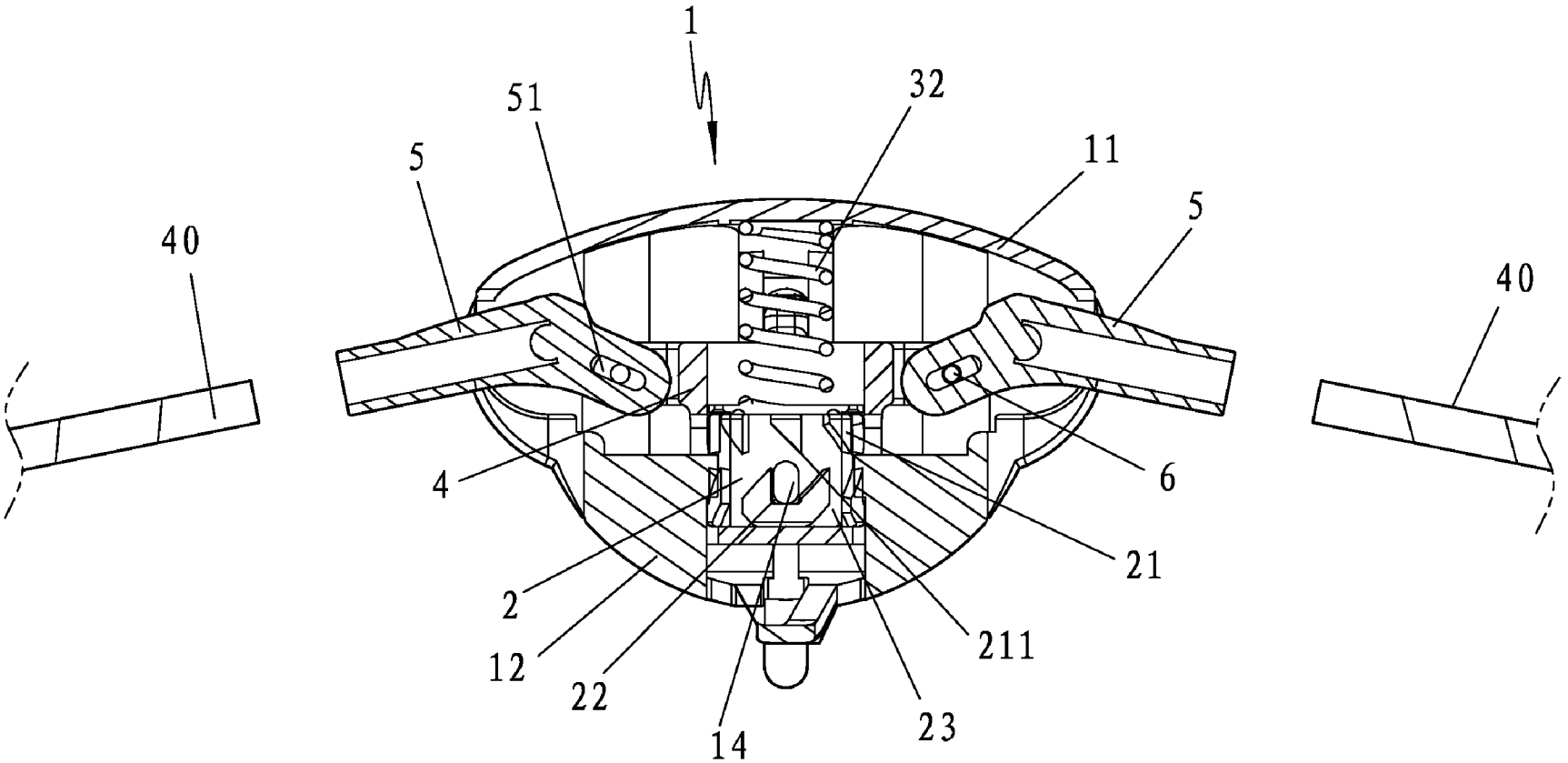
FIG. 5 is a sectional view showing the open configuration in the action 2 of the present invention.

Referring to FIG. 4 and FIG. 5, when intending to open the tent, firstly release all the roof strut sets 40, meanwhile under the restoring force coming from the spring 32 the sliding hub 4 is moved down at the inside of the central standing base 1 relatively along with the sliding guide coming from the match of the guide slots 411 and the locking pins 14 located at inside of the central standing base 1, in the same time the locking pins 14 stretch into the receding slots 23 of the tappet roller 2, cooperating to the slotted holes 51 of the connectors 5, and the pivoted fulcrum such as the pivots 53 of the middle portions of the connectors 5, the front rounded ends of the connectors 5 are smoothly moved down, so that the rear ends of the connectors 5 connecting the roof strut sets 40 are turned up following the principle of levers to draw themselves up, re-cooperating to an extra force exerting on the central standing base 1 to press it down relative to the roof strut sets 40, the sliding hub 4 brings the tappet roller 2 continuously to go down, then remove the extra force, under the weight force coming from the roof strut sets 40 the sliding hub 4 is stopped going down to move up, in this time the locking pins 14 can slide into the hook slots 22 along the beveled surfaces 221 so that the sliding hub 4 is located on the low portion of the central standing base 1, in this time the pivoting pins 6 connecting the connector 5 to the sliding hub 4 are positioned on the rear end of the slotted hole 51 of the connector 5, and the tent is in located open configuration.

Figure 6:
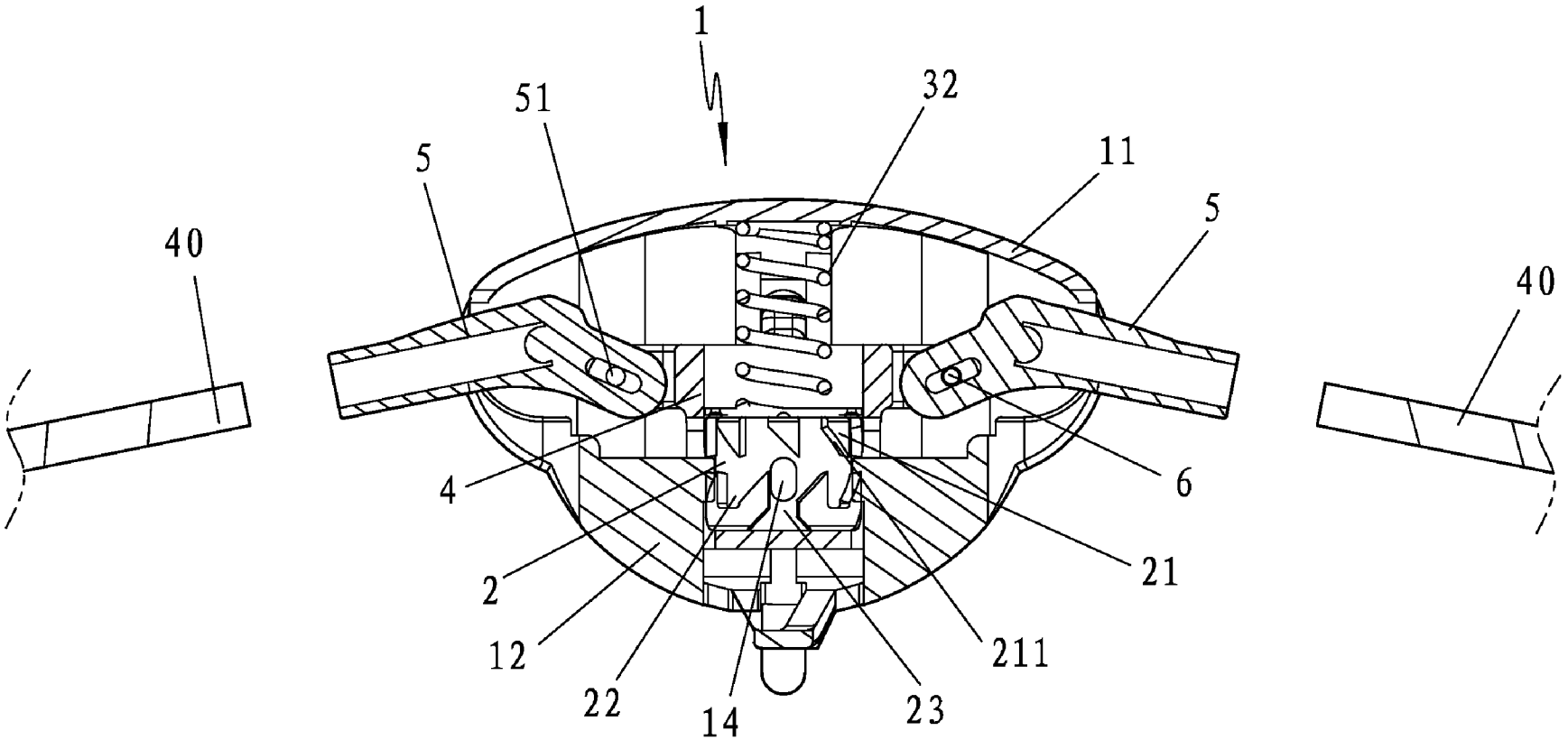
FIG. 6 is a perspective view showing the open configuration of the present invention.

Referring to FIG. 6 and FIG. 3, when intending to close the tent, press down the central standing base 1 again relative to the roof strut sets 40, so the sliding hub 4 brings the tappet roller 2 to move down to touch against the pushing lug 31 opposite the hook slot 22 and to push the tappet roller 2 turn an angle by sliding over along the beveled surface 211 so as to aim to the next beveled surface 221 tilted to the receding slot 23, then remove the extra force from the central standing base 1, under the weight force coming from the roof strut sets 40 the sliding hub 4 is stopped going down to move up, in this time the locking pins 14 can slide over the beveled surface 221 of the hook slots 22 to fall into the receding slot 23, so the sliding hub 4 is released from the location of the central standing base 1, along with closing all the roof strut sets 40, such as the sliding hub 4 going up relative to the central standing base 1, cooperating to the slotted holes 51 of the connectors 5, and the pivoted fulcrum such as the pivots 53 of the middle portions of the connectors 5, the front rounded ends of the connectors 5 are smoothly moved up until the rear ends of the connectors 5 connecting the roof strut sets 40 close to the center together, in this time the pivoting pins 6 connecting the connector 5 to the sliding hub 4 are positioned on the rear end of the slotted hole 51 of the connector 5, and the spring 32 is in the compressed accumulation configuration.

Of course, said spring sleeve 3 can be saved, just need to locate the spring 32 in the inside of the tappet roller 2, such as building up a locating lug at the inside of the tappet roller 2, the other way will not described here.

According to above-description, by means of the hollow cavity of the central standing base 1, cooperating to an extra force exerting on the central standing base 1 to press it down relative to the roof strut sets 40, the sliding hub 4 brings the tappet roller 2 continuously to go down and up, by means of the special design between the spring 32 and all the pushing lugs 21 and hook slots 22 of the tappet roller 2, positioning the sliding hub 4 with the locking pin 14 of the central standing base 1 can be carried out, so that the tent can be opened and kept in open configuration automatically; when repeatedly press down the central standing base 1 relative to the roof strut sets 40, by means of the special design between the spring 32 and all the pushing lugs 21 and hook slots 22 of the tappet roller 2, the sliding hub 4 can be released from the lock of the locking pin 14, so that the tent can be closed. Therefore, the present invention carry out automatically opening or closing the tent easily and conveniently; and the volume of the device is very small, compact and good look.

I claim:

1. An automatic control device for a foldable tent connecting to several roof strut sets; wherein, said automatic control device is comprised of a central standing base containing a sliding hub, a spring and a tappet roller inside;

said tappet roller is received inside of the sliding hub for adjoining one end of said spring axially, another end of said spring is adjoining a top inside surface of said central standing base;

said sliding hub is connected to connectors radially and pivotally;

said connectors are respectively pivoted on a rim of said central standing base at middle points, another ends of said connectors are individually connected to the roof strut sets;

several locking pins built inside of the central standing base for engaging with said tappet roller, coordinating to those said tappet roller with a plurality of beveled surfaces for the locking pins pushing to roll, and a plurality of catching slots for locking up the locking pins.

2. An automatic control device for a foldable tent as claimed in claim 1, wherein said sliding hub is shaped in a cross with a blind hole built upon a top center with several guide slots built on an inside wall of the blind hole axially.

3. An automatic control device for a foldable tent as claimed in claim 2, wherein said sliding hub has four connecting slots respectively built upon four extended legs, and each of said connecting slots has a through-hole built on a side wall crossly for pivoting.

4. An automatic control device for a foldable tent as claimed in claim 1, wherein said tappet roller is a bushing having a set of pushing lugs with a beveled surface disposed along a top edge thereof, and a set of hook slots disposed along a bottom edge thereof for forming a receding slot between two adjacent hook slots, therein an outward functional surface of said hook slot being a beveled surface, and each pushing lug facing a hook slot or a receding slot.

5. An automatic control device for a foldable tent as claimed in claim 4, wherein said tappet roller has four positioning pits built on the top side along the edge for setting reference points in combination.

6. An automatic control device for a foldable tent as claimed in claim 1, wherein said tappet roller also has a spring sleeve with a closed bottom end, said spring sleeve extends out a flange from the top edge, on said flange of the spring sleeve there are four salient points for engaging into the four positioning pits of said tappet roller.

7. An automatic control device for a foldable tent as claimed in claim 1, wherein said connector is an L-shaped bar, and has a pivoting slotted hole built on the front portion and a rounded front end; said connector is pivoted on said sliding hub with the slotted hole by a pivoting pin.

8. An automatic control device for a foldable tent as claimed in claim 1, wherein said central standing base has a plurality of notched slots built upon the rim in radial.

9. An automatic control device for a foldable tent as claimed in claim 1, wherein two pivots extending outwardly from two sides of a middle portion of said connector respectively for fitting into the pivot holes built on the notched slot of said central standing base.

10. An automatic control device for a foldable tent as claimed in claim 1, wherein said central standing base includes an upper cap and a low cap interlocked together, with said locking pins set upon an inside wall of said low cap.

* * * * *